US009285165B2

(12) United States Patent
Kim et al.

(10) Patent No.: US 9,285,165 B2
(45) Date of Patent: Mar. 15, 2016

(54) METHOD FOR CONTROLLING DRYER

(71) Applicant: LG Electronics Inc., Seoul (KR)

(72) Inventors: Jeongyun Kim, Seoul (KR); Sangik Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 608 days.

(21) Appl. No.: 13/709,285

(22) Filed: Dec. 10, 2012

(65) Prior Publication Data

US 2013/0145645 A1 Jun. 13, 2013

(30) Foreign Application Priority Data

Dec. 8, 2011 (KR) ..... 10-2011-0131006
Dec. 19, 2011 (KR) ..... 10-2011-0137562
Jan. 5, 2012 (KR) ..... 10-2012-0001670

(51) Int. Cl.

*D06F 58/28* (2006.01)
*D06F 58/22* (2006.01)
*F26B 21/00* (2006.01)
*D06F 58/04* (2006.01)

(52) U.S. Cl.

CPC ..... *F26B 21/003* (2013.01); *D06F 58/22* (2013.01); *D06F 58/04* (2013.01)

(58) Field of Classification Search

CPC ..... D06F 58/22
See application file for complete search history.

(56) References Cited

U.S. PATENT DOCUMENTS 2,743,532 A * 5/1956 Steward ..... 34/547
2,809,025 A * 10/1957 Pettyjohn ..... 432/68
3,122,426 A 2/1964 Horecky
3,286,508 A * 11/1966 Spiegel ..... 73/38
3,484,772 A * 12/1969 McConnell et al. ..... 340/607
3,579,851 A 5/1971 Elmy
3,639,998 A * 2/1972 Mason ..... 34/82
3,730,216 A 5/1973 Arnett
3,872,534 A 3/1975 Hoag
3,909,415 A 9/1975 Young
3,981,493 A * 9/1976 Klappenecker et al. ... 271/10.05
4,069,536 A 1/1978 Hartz
4,206,552 A * 6/1980 Pomerantz et al. ..... 34/445
4,244,638 A 1/1981 Little (Continued)

FOREIGN PATENT DOCUMENTS

CN 2448866 Y 9/2001
CN 101100802 A 1/2008

(Continued)

OTHER PUBLICATIONS

Russian Decision on Grant dated Nov. 11, 2014 for Russian Application No. 2013127288, with English Translation 16 Pages.

(Continued)

*Primary Examiner* — Kenneth Rinehart
*Assistant Examiner* — Logan Jones
(74) *Attorney, Agent, or Firm* — Fish & Richardson P.C.

(57) ABSTRACT

A method for controlling a dryer includes putting a brush driving unit into operation, after putting the brush driving unit into operation, gathering information related to the operation of the brush driving unit, and controlling operation of the dryer based on the gathered information related to the operation of the brush driving unit. The brush driving unit being is configured to drive a brush that separates foreign matter from a filter portion of a filter assembly positioned to contact air that has exited from a drum of the dryer.

15 Claims, 10 Drawing Sheets

(56) References Cited

U.S. PATENT DOCUMENTS

| | | | | |
|---|---|---|---|---|
| 4,380,839 | A | 4/1983 | Caradonna | |
| 4,472,851 | A | 9/1984 | Kinsey | |
| 4,508,488 | A * | 4/1985 | Pikna | 417/12 |
| 4,640,022 | A * | 2/1987 | Suzuki et al. | 34/552 |
| 4,676,839 | A | 6/1987 | Osborn | |
| 4,700,492 | A * | 10/1987 | Werner et al. | 34/403 |
| 5,006,136 | A | 4/1991 | Wetter | |
| 5,097,606 | A * | 3/1992 | Harmelink et al. | 34/467 |
| 5,168,888 | A | 12/1992 | Altwasser | |
| 5,281,956 | A * | 1/1994 | Bashark | 340/660 |
| 5,497,563 | A | 3/1996 | Mayfield | |
| 5,860,224 | A * | 1/1999 | Larson | 34/418 |
| 6,141,180 | A | 10/2000 | Smith | |
| 6,302,169 | B1 | 10/2001 | Pulos | |
| 6,792,694 | B2 * | 9/2004 | Lapierre | 34/446 |
| 6,794,632 | B1 * | 9/2004 | Steffen | 250/221 |
| 6,971,186 | B1 * | 12/2005 | Chin et al. | 34/82 |
| 7,040,039 | B1 * | 5/2006 | Stein et al. | 34/529 |
| 7,236,236 | B2 | 6/2007 | Hanaoka | |
| 7,236,326 | B2 | 6/2007 | Herring | |
| 7,305,775 | B2 * | 12/2007 | Favret et al. | 34/82 |
| 7,891,113 | B2 | 2/2011 | Oh | |
| 7,926,201 | B2 * | 4/2011 | Kim et al. | 34/524 |
| 8,240,064 | B2 | 8/2012 | Steffens | |
| 8,375,597 | B2 | 2/2013 | Ahn | |
| 8,387,268 | B2 | 3/2013 | Ahn | |
| 8,468,711 | B2 | 6/2013 | Kim | |
| 8,562,144 | B2 * | 10/2013 | Nakajima et al. | 353/61 |
| 8,786,454 | B2 * | 7/2014 | Siddall | 340/626 |
| 8,789,287 | B2 | 7/2014 | Kim et al. | |
| 9,096,970 | B2 | 8/2015 | Ko | |
| 2006/0005582 | A1 | 1/2006 | Lee | |
| 2006/0201014 | A1 | 9/2006 | Favret | |
| 2006/0261716 | A1 | 11/2006 | Chen | |
| 2008/0078100 | A1 * | 4/2008 | Kim et al. | 34/524 |
| 2008/0196268 | A1 * | 8/2008 | Jung et al. | 34/603 |
| 2008/0313923 | A1 | 12/2008 | Oh | |
| 2009/0064528 | A1 | 3/2009 | Kim | |
| 2009/0145001 | A1 * | 6/2009 | Oh et al. | 34/282 |
| 2010/0146812 | A1 * | 6/2010 | Ahn et al. | 34/480 |
| 2010/0154241 | A1 | 6/2010 | Ahn | |
| 2011/0016736 | A1 | 1/2011 | Kim | |
| 2011/0154587 | A1 | 6/2011 | Kim | |
| 2011/0225837 | A1 * | 9/2011 | Ahn et al. | 34/82 |
| 2011/0225838 | A1 * | 9/2011 | Ahn et al. | 34/82 |
| 2011/0271542 | A1 * | 11/2011 | Ko et al. | 34/90 |
| 2011/0271543 | A1 * | 11/2011 | Kim et al. | 34/90 |
| 2011/0271550 | A1 * | 11/2011 | Kim et al. | 34/480 |
| 2011/0297000 | A1 * | 12/2011 | Kotani et al. | 96/421 |
| 2012/0210598 | A1 * | 8/2012 | Hastings et al. | 34/572 |
| 2013/0145638 | A1 | 6/2013 | Kim | |
| 2013/0145645 | A1 | 6/2013 | Kim | |
| 2014/0154910 | A1 | 6/2014 | Conway | |

FOREIGN PATENT DOCUMENTS

| | | | |
|---|---|---|---|
| CN | 101173442 | A | 5/2008 |
| CN | 101173482 | A | 5/2008 |
| CN | 101187141 | A | 5/2008 |
| CN | 101289799 | A | 10/2008 |
| CN | 101760944 | A | 6/2010 |
| CN | 201897375 | U | 7/2011 |
| CN | 102257207 | A | 11/2011 |
| CN | 102257208 | A | 11/2011 |
| CN | 102884243 | A | 1/2013 |
| DE | 19924297 | A1 | 11/2000 |
| DE | 102006060031 | A1 | 6/2008 |
| EP | 1 614 792 | A1 | 1/2006 |
| EP | 1 719 833 | A1 | 11/2006 |
| EP | 2 365 122 | A1 | 9/2011 |
| JP | 06-091096 | A | 4/1994 |
| JP | 06-098993 | A | 4/1994 |
| JP | 07-000694 | A | 1/1995 |
| JP | 2008-194439 | A | 8/2008 |
| KR | 10-0664507 | B1 | 1/2007 |
| KR | 10-2011-0123359 | A | 11/2011 |
| RU | 69524 | U1 | 12/2007 |
| WO | WO 2008/074581 | A1 | 6/2008 |
| WO | WO 2010/071354 | A2 | 6/2010 |
| WO | WO 2010/071355 | A2 | 6/2010 |
| WO | WO 2011/147009 | A2 | 12/2011 |
| WO | WO 2013/085350 | A1 | 6/2013 |

OTHER PUBLICATIONS

Chinese Office Action dated Jan. 22, 2015, for Chinese Application No. 201280003766.4, with English Translation, 13 pages.
Chinese Office Action dated Feb. 27, 2015, for Chinese Application No. 201280003746.7, with English Translation, 22 pages.
Chinese Office Action dated Mar. 4, 2015 for Chinese Application No. 201280007214.0, with English Translation, 10 Pages.
PCT International Search Report dated Mar. 25, 2013 for Application No. PCT/KR2012/010645, 10 pages.
PCT International Search Report dated Apr. 29, 2013, for Application No. PCT/KR2012/010652, 8 pages.
Russian Decision of Grant dated Mar. 31, 2014 for Application No. 2013128376, with English Translation, 17 pages.
PCT International Search Report and Written Opinion dated Apr. 29, 2013 for Application No. PCT/KR2012/010652, 8 pages.
PCT International Search Report dated Mar. 25, 2013 for Application No. PCT/KR2012/010646, 11 pages.
U.S. Office Action dated Oct. 17, 2014 for U.S. Appl. No. 13/709,323, 7 pages.
European Search Report dated Aug. 19, 2015 for Application No. 12855822.8, 10 pages.
Chinese Office Action dated Aug. 26, 2015 for Chinese Application No. 201280003746.7, with English Translation, 20 pages.
U.S. Office Action dated Jul. 9, 2015, for U.S. Appl. No. 13/709,316, 20 pages.
U.S. Final Office Action dated Nov. 18, 2015 U.S. Appl. No. 13/709,316, 26 pages.

* cited by examiner

METHOD FOR CONTROLLING DRYER

CROSS REFERENCE TO RELATED APPLICATION

This application claims the benefit of the Korean Patent Application Nos. 10-2011-0131006, filed on Dec. 8, 2011; 10-2011-0137562 filed on Dec. 19, 2011 and 10-2012-0001670 filed on Jan. 5, 2012, which are hereby incorporated by reference as if fully set forth herein.

TECHNICAL FIELD

This application relates to a method for controlling a dryer which enables automatic cleaning of a filter assembly which removes foreign matter from air being discharged from a drum.

BACKGROUND

In general, a dryer is a machine for drying laundry by supplying heated air to laundry.

The air discharged to an outside of the drum from the inside of the drum after heat exchange with the laundry absorbs moisture from the laundry in the drum, to become humid and high temperature air. The dryer may be classified as follows.

For example, an exhaust type dryer discharges humid and high temperature air from the drum to the outside of the dryer, while a condensing type dryer, in which a heat exchanger condenses and heats the air from the drum during operation, re-supplies the humid and high temperature air to the drum (i.e., recirculates the air discharged from the drum).

In general, the air being discharged from the drum during drying may contain foreign matter, such as lint or the like, from the object being dried, such as clothes. The foreign matter can damage the dryer if accumulated on elements of the dryer, can also pollute air by discharging foreign matter to the outside of the dryer. Therefore, the dryer is required to remove the foreign matter from the air that is being discharged from the drum.

In general, a filter provided to the dryer is positioned on a front of the drum for filtering the foreign matter from the air being discharged from the drum. Accordingly, if the dryer is used continuously, the filter has the foreign matter, such as lint, accumulated thereon.

If the accumulation of the foreign substance on the filter becomes greater than a preset level, the foreign substance can interfere with the discharge of the air from the drum; thus, the filter in the dryer should be cleaned periodically. The filter cleaning is carried out as the user separates the filter from the dryer after finishing a drying cycle, and removes the foreign matter from the filter.

However, such filter cleaning carried out manually may not only be cumbersome but also, because the filter cleaning may not be carried out every time the dryer is operated, can lead to, until the filter is cleaned, a failure to secure adequate air flow rate required for drying due to the foreign substance interfering with the air flow being discharged from the drum.

SUMMARY

According to one aspect, a method for controlling a dryer includes putting a brush driving unit into operation, after putting the brush driving unit into operation, gathering information related to the operation of the brush driving unit, and controlling operation of the dryer based on the gathered information related to the operation of the brush driving unit. The brush driving unit being is configured to drive a brush that separates foreign matter from a filter portion of a filter assembly positioned to contact air that has exited from a drum of the dryer.

Implementations of this aspect may include one or more of the following features. For example, putting the brush driving unit into operation and gathering information related to the operation of the brush driving unit may take place before starting a drying cycle. The method may further include receiving a user input command to start the drying cycle. Putting the brush driving unit into operation may include putting the brush driving unit into operation in response to the user input command to start the drying cycle. Gathering information related to the operation of the brush driving unit may include gathering information that indicates whether or not the operation of the brush driving unit was successful. Controlling operation of the dryer based on the gathered information related to the operation of the brush driving unit may include controlling the dryer to start the drying cycle based on the gathered information indicating that the operation of the brush driving unit was successful. Putting the brush driving unit into operation and gathering information related to the operation of the brush driving unit may take place before heated air is supplied to the drum. Gathering information related to the operation of the brush driving unit may include determining a position of the brush during the operation of the brush driving unit. Controlling operation of the dryer based on the gathered information related to the operation of the brush driving unit may include controlling operation of the dryer based on the position of the brush during the operation of the brush driving unit. determining the position of the brush during the operation of the brush driving unit may include detecting whether a first sensor detects an end of the brush at a first end point of rotational movement of the brush, detecting whether a second sensor detects the end of the brush at a second end point of the rotational movement of the brush, and determining whether the end of the brush is sensed by neither the first sensor nor the second sensor, one of the first sensor and the second sensor, or both of the first sensor and the second sensor. The second sensor may be different from the first sensor and the second end point of the rotational movement of the brush may be spaced apart from the first end point. Controlling operation of the dryer based on the position of the brush during the operation of the brush driving unit may include controlling the operation of the dryer to progress based on a determination that the end of the brush is sensed by one of the first sensor and the second sensor or both of the first sensor and the second sensor. The method may further include alerting a user of foreign matter in the filter assembly based on a determination that the end of the brush is sensed by one of the first sensor and the second sensor. Controlling operation of the dryer based on the position of the brush during the operation of the brush driving unit may include controlling the operation of the dryer to stop based on a determination that the end of the brush is sensed by neither the first sensor nor the second sensor. The method may further include alerting a user that either foreign matter needs to be removed from the filter assembly or that the filter assembly has not been properly inserted based on the determination that the end of the brush is sensed by neither the first sensor nor the second sensor. Putting the brush driving unit into operation may include operating the brush driving unit at predetermined periods during the operation of the dryer. The method may further include supplying heated air to the drum and discharging the heated air from the drum through a duct. The heated air may be supplied by a heater that operates at a temperature below a preset temperature. The heater may be configured to stop operation based on the temperature exceeding the preset temperature. The method may further include detecting that an operation period of the heater is longer than a reference period, and based on detection that the operation period of the heater is longer than the reference period, determining whether the filter portion is blocked by foreign matter or the duct is blocked by foreign matter. Determining whether the filter portion is blocked by foreign matter or the duct is blocked by foreign matter may include putting the brush driving unit into operation and gathering information related to the operation of the brush driving unit. Gathering information related to the operation of the brush driving unit may include determining a position of the brush during the operation of the brush driving unit. Determining the position of the brush during the operation of the brush driving unit may include detecting whether a first sensor detects an end of the brush at a first end point of rotational movement of the brush, detecting whether a second sensor detects the end of the brush at a second end point of the rotational movement of the brush, and determining whether the end of the brush is sensed by neither the first sensor nor the second sensor, one of the first sensor and the second sensor, or both of the first sensor and the second sensor. The second sensor may be different from the first sensor and the second end point of the rotational movement of the brush being spaced apart from the first end point. Determining whether the filter portion is blocked by foreign matter or the duct is blocked by foreign matter may include determining that the duct is blocked by foreign matter based on a determination that the end of the brush is sensed by one of the first sensor and the second sensor or both of the first sensor and the second sensor, and may further include alerting a user of foreign matter in the duct based on the determination that the duct is blocked by foreign matter. Determining whether the filter portion is blocked by foreign matter or the duct is blocked by foreign matter may include determining that the filter portion is blocked by foreign matter based on a determination that the end of the brush is sensed by neither the first sensor nor the second sensor, and may further include alerting a user of foreign matter in the filter portion based on the determination that the filter portion is blocked by foreign matter.

According to another aspect, a method for controlling a dryer includes attempting to determine a position of a brush that separates foreign matter from a filter portion of a filter assembly positioned to contact air that has exited from a drum of the dryer, and operating the dryer based on the attempt to determine the position of the brush.

Implementations of this aspect may include one or more of the following features. For example, attempting to determine a position of a brush that separates foreign matter from a filter portion of a filter assembly positioned to contact air that has exited from a drum of the dryer may include detecting whether a first sensor detects an end of the brush at a first end point of rotational movement of the brush, detecting whether a second sensor detects the end of the brush at a second end point of the rotational movement of the brush, and determining whether the end of the brush is sensed by neither the first sensor nor the second sensor, one of the first sensor and the second sensor, or both of the first sensor and the second sensor. The second sensor may be different from the first sensor and the second end point of the rotational movement of the brush being spaced apart from the first end point. Operating the dryer based on the attempt to determine the position of the brush may include stopping operation of the dryer based on a determination that the end of the brush is sensed by neither the first sensor nor the second sensor, enabling operation of the dryer and providing an alert to clean the filter assembly based on a determination that the end of the brush is sensed by one of the first sensor and the second sensor, and enabling operation of the dryer without providing an alert based on a determination that the end of the brush is sensed by both of the first sensor and the second sensor.

According to another aspect, a method for determining a source of clogging in a dryer includes supplying heated air to a drum and discharging the heated air from the drum through a duct, detecting that an operation period of the heater is longer than a reference period, and based on detection that the operation period of the heater is longer than the reference period, determining whether a filter portion of a filter assembly is blocked by foreign matter or the duct is blocked by foreign matter. The heated air may be supplied by a heater that operates at a temperature below a preset temperature. The heater may be configured to stop operation based on the temperature exceeding the preset temperature. The filter portion may be positioned to contact air that has exited from a drum of the dryer. Determining whether the filter portion is blocked by foreign matter or the duct is blocked by foreign matter may include determining a position of a brush during operation of a brush driving unit. The brush may separate foreign matter from the filter portion of the filter assembly based on operation of the brush driving unit. Determining the position of the brush during the operation of the brush driving unit may include detecting whether a first sensor detects an end of the brush at a first end point of rotational movement of the brush, detecting whether a second sensor detects the end of the brush at a second end point of the rotational movement of the brush, and determining whether the end of the brush is sensed by neither the first sensor nor the second sensor, one of the first sensor and the second sensor, or both of the first sensor and the second sensor. The second sensor may be different from the first sensor and the second end point of the rotational movement of the brush being spaced apart from the first end point. Determining whether the filter portion is blocked by foreign matter or the duct is blocked by foreign matter may include determining that the duct is blocked by foreign matter based on a determination that the end of the brush is sensed by one of the first sensor and the second sensor or both of the first sensor and the second sensor, and determining that the filter portion is blocked by foreign matter based on a determination that the end of the brush is sensed by neither the first sensor nor the second sensor.

According to another aspect, a method for controlling a dryer including a drum for holding drying objects, an air supply unit for supplying air to the drum, a duct for discharging the air from an inside of the drum, a filter assembly detachably mounted to the duct, the filter assembly having a filter portion for filtering the air being discharged from the drum, and a brush for removing foreign matter from the filter portion, a brush driving unit for making the brush to reciprocate a region of the filter portion, and position sensing means for sensing a position of the brush, the method includes a mount sensing step for determining whether the filter assembly is mounted to the duct or not depending on whether the position sensing means senses a position of the brush or not after putting the brush driving unit into operation temporarily, an air supply step for putting the air supply unit into operation to supply the air to the drum, and a filter cleaning step for controlling the brush driving unit to make the brush to remove the foreign matter from the filter portion during the air supply step is in progress.

The method may further include a pre-drying notifying step for requesting the user to inspect the filter assembly with a display unit or a speaker provided to the dryer if the position sensing means cannot sense the position of the brush in the mount sensing step.

The position sensing means may include magnetic force generating means provided to the brush, and two magnetic force sensing means for sensing whether the magnetic force generating means reaches to limiting points of the reciprocating movement of the brush or not, wherein the air supply step may be progressed if at least one of the two magnetic force sensing means senses a position of the magnetic force generating means.

If only one of the two magnetic force sensing means senses the position of the magnetic force generating means, the pre-drying notifying step may include the step of requesting the user to remove the foreign matter from the filter assembly.

The position sensing means may include magnetic force generating means provided to the brush, and two magnetic force sensing means for sensing whether the magnetic force generating means reaches to limiting points of the reciprocating movement of the brush or not, wherein, if both of the two magnetic force sensing means cannot sense the position of the magnetic force generating means, the pre-drying notifying step may progress the step of requesting the user to remove the foreign matter from the filter assembly, and stopping operation of the dryer.

The filter cleaning step may be repeated at predetermined periods during the air supply step is in progress.

The position sensing means may include magnetic force generating means provided to the brush, and two magnetic force sensing means for sensing whether the magnetic force generating means reaches to limiting points of the reciprocating movement of the brush or not, wherein the filter cleaning step further includes an in-drying notifying step for requesting the user to inspect the filter assembly with the display unit or the speaker, if at least one of the two magnetic force sensing means cannot sense the position of the magnetic force generating means during the filter cleaning step is in progress.

If both of the two magnetic force sensing means cannot sense the position of the magnetic force generating means, in the in-drying notifying step, the step of requesting the user to remove the foreign matter from the filter assembly, and stopping operation of the dryer is progressed.

And, if only one of the two magnetic force sensing means senses the position of the magnetic force generating means, in the in-drying notifying step, the step of requesting the user to remove the foreign matter from the filter assembly may be progressed.

In the meantime, the air supply step may include the step of supplying heated air to the drum with the heating means and the fan provided to the duct.

And, the method may further include a cooling step for putting the fan into operation in a state the operation of the heating means is stopped if dryness of the drying object in the drum reaches to a preset dryness during the air supply step is in progress.

The method may further include a brush final driving step for controlling the brush driving unit for removing the foreign matter from the filter portion for a predetermined time period with the brush during the cooling step is in progress or after the cooling step is finished, a final notifying step for requesting the user to inspect the filter assembly with the display unit or the speaker provided to the dryer if the position sensing unit cannot sense the position of the brush during the brush final driving step is in progress, and a step for finishing operation of the dryer after finishing the final notifying step.

In the meantime, the air supply step may include the step of supplying the heated air to the drum with the fan provided to the duct and the heating means which operates at a temperature below a preset temperature and stops the operation if the preset temperature is exceeded.

In this case, the filter cleaning step may be progressed if an operation period of the heating means is longer than a reference period during the air supply step is in progress, and a blocking sorting step is progressed for determining whether the duct is blocked by the foreign matter or the filter portion is blocked by the foreign matter if the operation period of the heating means is shorter than the reference period during the air supply step is in progress.

The position sensing means may include magnetic force generating means provided to the brush, and two magnetic force sensing means for sensing whether the magnetic force generating means reaches to limiting points of the reciprocating movement of the brush or not, and the blocking sorting step may include a step for controlling the brush driving unit to drive the brush for a predetermined time period, a step for notifying the user of blocking of the duct with the display unit or the speaker if at least one of the two magnetic force sensing means senses the position of the magnetic force generating means, and a step for notifying the user of blocking of the filter portion with the display unit or the speaker if both of the two magnetic force sensing means senses the position of the magnetic force generating means.

And, the method may further include a step of stopping the operation of the dryer after finishing the step of notifying the blocking of the duct.

And, the method may further include a step of stopping the operation of the dryer after finishing the step of notifying the blocking of the filter portion.

Advantageous Effects

This application provides a method for controlling a dryer, which can sense mounting of a filter assembly to the dryer at an initial operation stage of the dryer.

This application provides a method for controlling a dryer, which can stop operation of the dryer if a filter assembly is not mounted to the dryer.

This application provides a method for controlling a dryer, which can sense an amount of foreign matter stored in a filter assembly and notify the user of the same.

This application provides a method for controlling a dryer, which stops operation of the dryer if an amount of foreign matter stored in a filter assembly reaches to an amount that drops drying efficiency.

This application provides a method for controlling a dryer, which can sense blocking of a duct which discharges air from an inside of a drum to an outside of the drum.

It is to be understood that both the foregoing general description and the following detailed description of this application are exemplary and explanatory.

BRIEF DESCRIPTION OF THE DRAWINGS

The accompanying drawings, which are included to provide a further understanding of the disclosure and are incorporated in and constitute a part of this application, serving together with the description to explain various aspects of technology. In the drawings.

DETAILED DESCRIPTION

Reference will now be made in detail to various specific implementations and examples, illustrations of which are provided in the accompanying drawings.

In addition, a configuration or a control method of a device described hereinafter is provided only for describing example implementations, but not for limiting scope of patent rights. Wherever possible, the same reference numbers will be used throughout the drawings to refer to the same or like parts.

Figure 1:
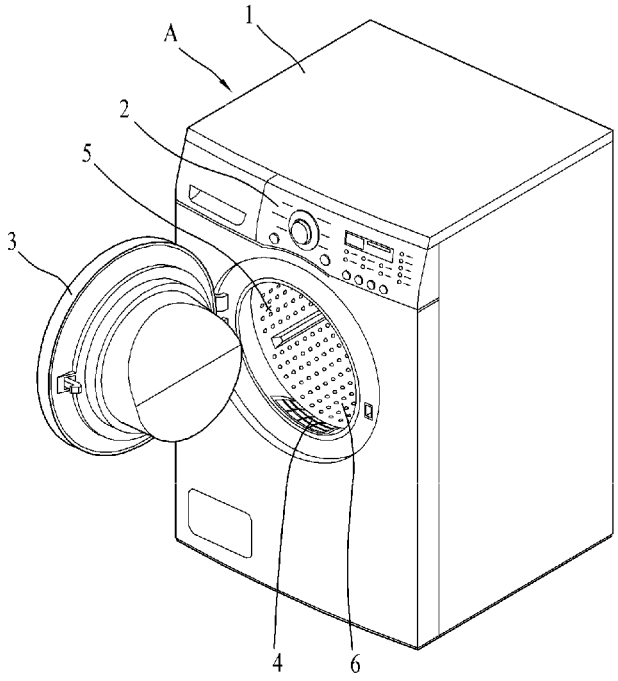
FIG. 1 illustrates a schematic view showing an exterior appearance of a dryer.

Referring to FIG. 1, a dryer A includes a body 1, or a cabinet, which forms an exterior appearance of the dryer, and a drum 6 rotatably mounted in the cabinet to have an inside circumferential surface with a plurality of lifters provided thereon.

Formed in a front of the cabinet 1, there is an introduction opening 5 for introduction of clothes that are drying objects.

The introduction opening 5 is opened/closed by a door 3, and positioned over the introduction opening 5, there is a control panel 2 having different operation buttons and a display unit arranged thereon for operating the dryer.

Figure 2:
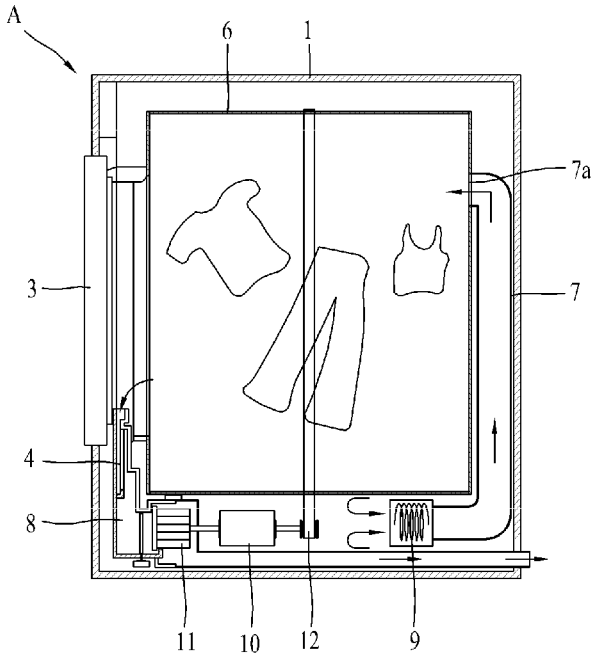
FIG. 2 illustrates a schematic view showing in inside of a dryer.

FIG. 2 illustrates a schematic view of an inside of the dryer.

Referring to FIG. 2, the drum 6 is rotatably mounted in the cabinet 1 for holding drying objects therein for drying the same. The drum 6 is rotatably supported at a front and a rear thereof by supporters (not shown).

The drum 6 is connected to a driving motor 10 provided under the dryer with a power transmission belt 12 to have rotating force applied thereto. The driving motor 10 has one side provided with a pulley with the power transmission belt 12 connected thereto for driving the drum.

Mounted in rear of the drum 6, there is a suction air duct 7 provided with heating means 9 for heating the air being drawn thereto. The suction air duct is connected to a rear side of the drum with an outlet 7*a* thereof, and the air heated by the heating means 9 is supplied to the drum through the outlet 7*a*.

Mounted under a front side of the drum 6, there are a filter 4 for filtering foreign matter, such as lint, or the like, from the air being discharged from the drum, and an air discharge duct 8 for discharging the air having the foreign matter removed therefrom to an outside of the cabinet 8.

That is, the air discharge duct 8 is provided under a front side of the drum 6 for discharging the air from an inside of the drum to an outside of the cabinet 1. Since a filter 4 is detachably provided to the air discharge duct 8, the air being discharged from the drum is discharged to the outside of the cabinet 1 after the air is filtered at the filter 4.

While FIG. 2 illustrates an exhaust type dryer which discharges the air being discharged from the drum to an outside of the dryer, a circulating type dryer (i.e., the air discharge duct is connected to the air suction duct, and heat exchange means is provided, which enables condensing and heating of the air introduced to the air discharge duct) that supplies the air discharged from the drum back again to the drum may also be used.

The air discharge duct 8 has a fan 11 for making the air to move from the inside of the drum 6 to the air discharge duct. For example, in a case of the exhaust type dryer in FIG. 2, the air discharge duct serves to lead the air forcibly blown by the fan 11 to an outside of the dryer. However, in a case of the circulating type dryer, the air discharge duct will serve to lead the air discharged by the fan to the air suction duct.

Figure 3:
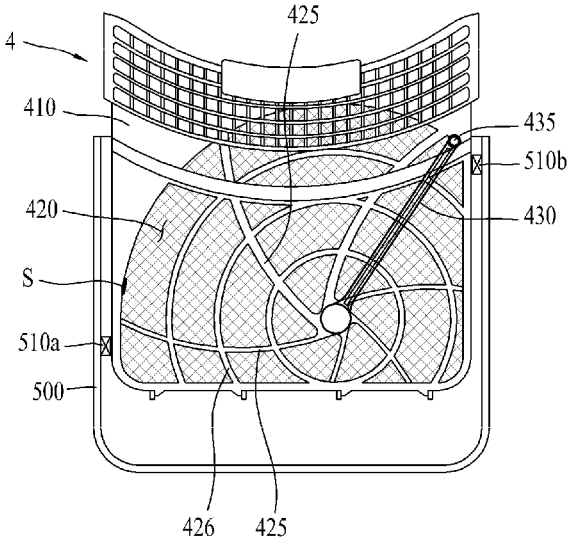
FIG. 3 illustrates a schematic view showing a structure of a filter assembly.

The filter 4 has different elements coupled together. Therefore, in description hereafter, the filter 4 will be called as a filter assembly. FIG. 3 illustrates an example of the filter assembly.

The filter assembly 4 is attachable/detachable to/from the cabinet 1 through the air discharge duct 8. An attachable/detachable position of the filter assembly is the front of the drum 6 or the periphery of the introduction opening.

Referring to FIG. 3, the filter assembly 4 is mounted to a filter guide 500 provided to the cabinet 1. That is, the filter guide 500 is provided to an inside of the air discharge duct 8, not only to make the filter assembly 4 detachable from the air discharge duct 8, but also to serve guide of the movement of the filter assembly 4 to a designated position.

The filter assembly 4 includes a case 410 which forms an exterior appearance of the filter assembly 4, a filter portion 420 formed on one side the case for filtering the air from the air being discharged from the drum, and a brush 430 rotatably provided to the case for separating the foreign matter left to the filer portion from the filter portion.

The case 410 forms an exterior appearance of the filter assembly. The case 410 has two sides opposite to each other each provided with the filter portion 420. The two sides provided to the case are connected with a bottom (not shown). Therefore, the case 410 forms a box shape provided with a space therein.

Though not shown in the drawing, a side having a width the same with the bottom is also formed on each sides of the case to make the opposite two sides of the case to maintain a predetermined gap.

The filter portion 420 is means provided to the case for passing the air from the drum therethrough to filter the foreign matter from the air. The case 410 has an opening S formed therein where the filter portion may be constructed, and as a mesh (not shown) form of a filter member covers the opening S, the filter portion 420 is constructed.

As described previously, if the case 410 has two sides, the filter portion 420 may be provided to each of the two sides of the case, or only one of the two sides.

The brush 430 is rotatably provided in the case 410 for separating the foreign matter left to the filter portion 420 from a surface of the filter portion 420. The brush 430 having a generally rod shape is secured to the case 410 with a rotation shaft.

The rotation shaft (not shown) has a brush driving gear (not shown) coupled thereto, and the brush driving gear (not shown) has rotation power transmitted thereto from a brush driving motor (not shown) through a motor gear (not shown) provided to a rotation shaft of the brush driving motor.

In addition, since the filter assembly 4 is required to be mounted to the air discharged duct 8 detachably, it may be preferable that the brush driving gear (not shown) be positioned on an outside of the case 410, and that the motor gear (not shown) be provided in the air discharge duct 8. In this case, the motor gear may be provided to be secured to the rotation shaft of the brush driving motor which is passed through the air discharge duct 8.

The opening S may have radial frames 425 and concentric frames 246 provided thereto, additionally.

The radial frames 425 may be provided radially from a rotation center of the brush frame 430 toward an outside circumference of the opening (i.e., an outside circumference of the filter portion). In this case, the radial frame 425 may be provided to have predetermined radius of curvature.

Further, the concentric frame 426 may be provided as an arc, or circular frame having a center the same with the rotation center of the brush frame 430 to connect the radial frames 425 together.

This can prevent the filter portion 420 cleaned by the brush 430 from becoming damaged. Additionally, if the radial frame 425 is provided with a plurality of projections which are able to be brought into contact with the brush 430, the radial frame 425 may also carry out a function of a scraper for separating the foreign matter from the brush 430.

Figure 4:
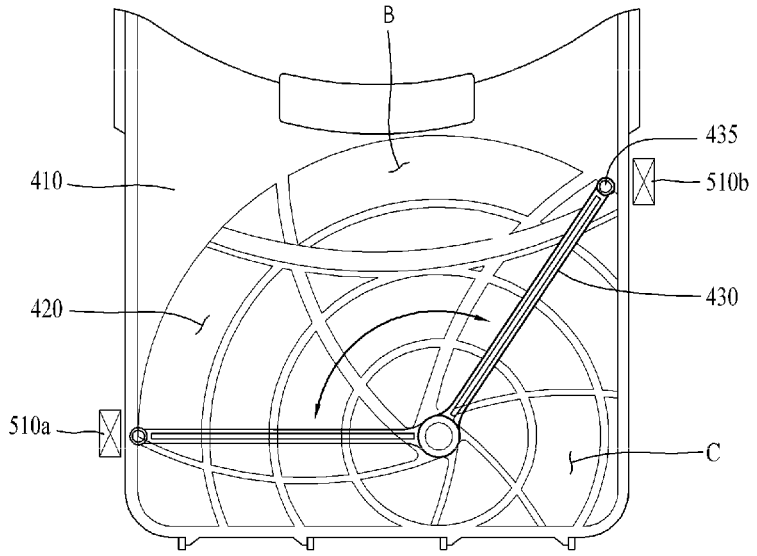
FIG. 4 illustrates a schematic view showing a rotation range of a brush in the filter assembly in FIG. 3.

FIG. 4 illustrates a reciprocating movement range (Rotary reciprocating range) of the brush 430. The brush may reciprocate within a region of the filter portion 420.

The filter portion 420 is provided to have a form which forms a portion of a circle (e.g., an arc, a semi-circle, or the like), or a combination of the form which forms a portion of the circle and a polygon (e.g., a square or the like) with reference to the rotation center of the brush 430. In this case, the brush is provided to have a length the same with a maximum radius of the arc or the semi-circle the filter portion 420 forms.

Moreover, the brush 430 can reciprocate within a predetermined range of angle set in advance with reference to the rotation center of the brush 430. However, a shape of the filter portion 420 shown in FIG. 3 or 4 is only an example, and the shape of the filter portion 420 may be provided to have a variety of shapes which can be cleaned by the brush 430.

In some cases, the brush 430 may have magnetic force generating means 435. In this case, the filter guide 500 may have magnetic force sensing means provided thereto for sensing a position of the magnetic force generating means 435. That is, the magnetic force generating means 435 may be provided in a form of a magnet or an electric magnet at an end of the brush 430, and the magnetic force sensing means may be provided in forms of lead switches 510*a* and 510*b* to the filter guide 500. Alternatively, the filter guide 500 may include other sensors or sensing mechanisms that can detect an end of the brush 430. The lead switches 510*a* and 510*b* can be provided to limiting points of the reciprocating movement of the brush 430.

While FIGS. 3 and 4 show the lead switches provided to the filter guide 500, the illustrations are only examples. Therefore, the lead switches may be mounted to other positions of the dryer (e.g., the air discharge duct, or the like) as long as the positions are such that the lead switches can sense, for example, the magnetic force generating means.

The lead switch 510*a* or 510*b* is activated as the magnetic force generating means 435 approaches thereto to sense movement of the brush. In this case, the lead switch is connected to a controller (not shown) provided to the dryer. Accordingly, the controller can sense the movement of the brush to sense an amount of the foreign matter stored in the filter assembly 4 or malfunction of the filter assembly 4, which will be described in more detail below.

The filter portion 420 may be divided into a filter cleaning region where the brush 430 makes rotary reciprocating movement, and a lint compression region where the foreign matter fallen off the filter portion is accumulated.

The filter cleaning region is shown as region B in FIG. 4, which is a portion to be brought into contact with the brush 430 to separate the foreign matter from the filter portion 420 when the brush 430 moves.

The lint compression region is shown as region C in FIG. 4, in which the brush 430 is not brought into contact with the filter portion 420, providing a space where the foreign matter moved to the lint compression region C by the brush 430 can be stored.

In addition, the foreign matter stored in the lint compression region is compressed by the brush 430 as the foreign matter is pressed by the brush 430 when the brush 430 reciprocates.

Figure 5:
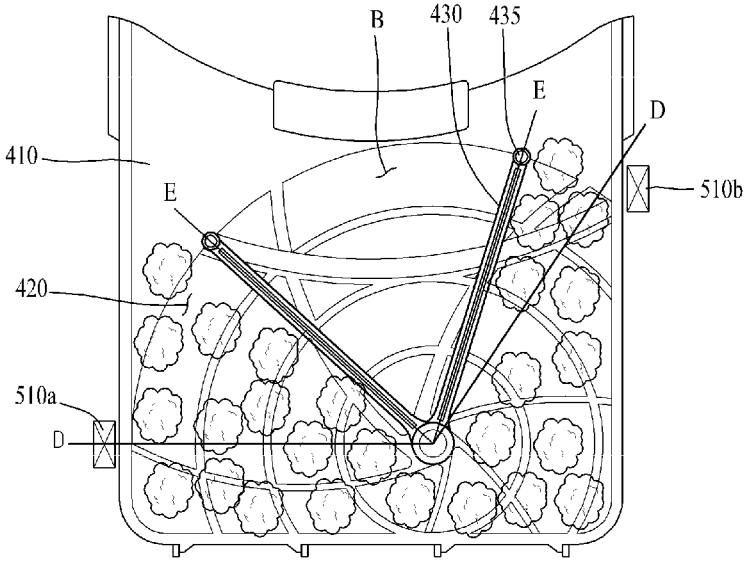
FIG. 5 illustrates a schematic view showing a rotation range of a brush if foreign matter is accumulated in the filter assembly in FIG. 4.

FIG. 5 illustrates a state the foreign matter is accumulated in the filter assembly 4.

Lines D illustrated in FIG. 5 denote the limiting points of the reciprocating movement of the brush 430, along which the lead switches 510*a* and 510*b* are positioned.

If much foreign matter is stored in the case 410 of the filter assembly 4 (e.g., when the case is filled with the foreign matter fully and requires cleaning), the brush 430 will fail to reach to the limiting points D of the reciprocating movement of the brush, but can rotate up to dashed lines.

In this case, since the lead switches 510*a* and 510*b* will fail to sense the magnetic force generating means 435 provided to the brush, the controller (not shown) can determine that the filter assembly 4 is completely filled with the foreign matter.

Since an air flow rate passing through the filter portion 420 becomes lower if the filter assembly 4 is filled with the foreign matter fully as shown in FIG. 5, the drying efficiency may be reduced. Therefore, it may be required that the controller notify the user of a filter assembly cleaning time according to an amount of the foreign matter stored in the filter assembly.

Figure 6:
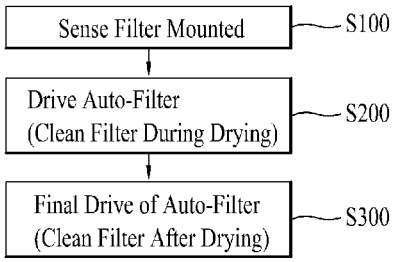
FIGS. 6 and 7 illustrate flow charts showing the steps of exemplary methods for controlling a dryer for auto-cleaning of a filter portion, respectively.
Figure 7:
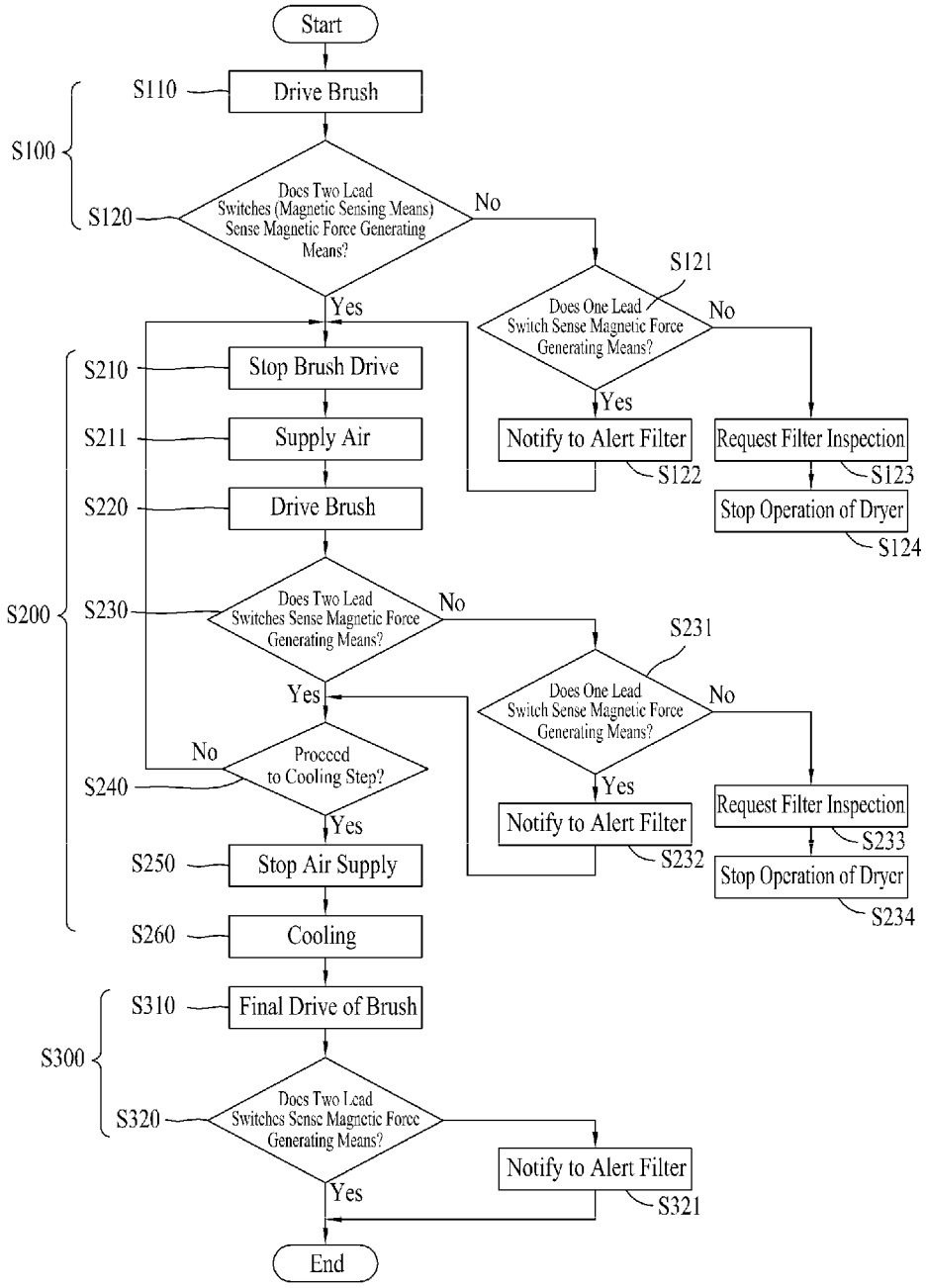
Figure 8:
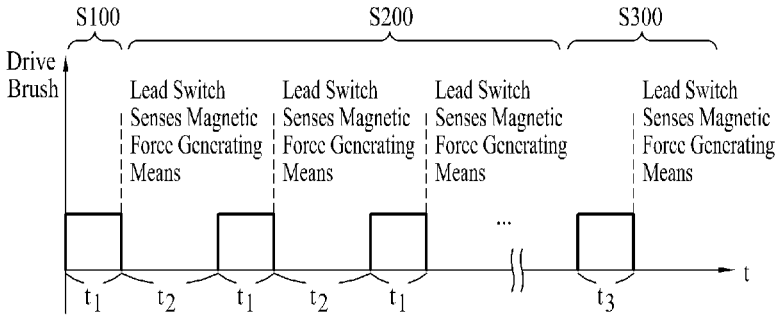
FIG. 8 illustrates a graph showing brush driving vs. time.

FIGS. 6 to 8 illustrate methods for controlling a dryer for auto-cleaning of the filter portion 420, respectively.

The method in accordance with the implementation may include a mount sensing step S100 for determining whether the filter assembly 4 is mounted to a dryer or not before air is supplied to a drum, a drying step (a driving step or a filter cleaning step during drying) S200 for cleaning a filter portion 420 with a brush 430 periodically while the air is supplied to the drum, and a final driving step (a filter cleaning step after drying) S300 for cleaning the filter portion 420 with the brush 430 for a predetermined time period before finishing operation of the dryer (after finishing air supply to the drum).

The dryer has an effect of enabling the dryer to notify the user of whether the filter assembly is mounted to a duct or not as well as whether removal of foreign matter stored in the filter assembly is required or not by sensing a position of the brush or sensing whether the brush makes reciprocating movement or not with a position sensing unit (Provided as magnetic force generating means and magnetic force sensing means).

The duct is an air discharge duct 8 in a case of the exhaust type dryer, and an entire flow passage having the air discharge duct 8 and the air suction duct 7 connected together in a case of the circulating type dryer.

Moreover, the dryer has an effect of preventing the dryer from having poor efficiency or from going wrong by stopping operation of the dryer according to an amount of the foreign matter stored in the filter assembly by sensing a position of the brush or sensing whether the brush makes reciprocating movement or not with the position sensing unit.

Steps of an example control method will be described with reference to FIGS. 7 and 8.

The mount sensing step S100 determines whether the filter assembly 4 is mounted to the duct 8 or not and whether removal of the foreign matter from an inside of the case 410 of the filter assembly 4 is required or not by determining whether the lead switches (e.g., magnetic force sensing means 510*a* and 510*b*) positioned at the limiting points D of the reciprocating movement of the brush 430 sense the magnetic force generating means 435 provided to the brush or not at an initial stage of the dryer (Before starting the drying step).

Since the drying step S200 starts by putting an air supply step S211 into practice in which unheated or heated air is supplied to a drum 6, it may be preferable that the mount sensing step S100 be put into practice before the air supply step S211.

To do this, the mount sensing step S100 includes a brush driving step S110 for operating a brush driving unit, such as a brush driving motor (not shown), for a predetermined time period, and a brush sensing step S120 for gathering information related to the operation of the brush driving unit, for example sensing a position of the magnetic force generating means 435 with the lead switches 510*a* and 510*b* during the brush driving step is in progress.

In the brush driving step S110, the brush driving unit (not shown) is controlled to make the brush 430 to reciprocate the filter cleaning region B of the filter portion 420 for a predetermined time period to transfer the foreign matter to the lint compression region C. That is, if the filter assembly 4 is mounted to the duct, the brush 430 reciprocates the filter cleaning region B for a predetermined time period t1 shown in FIG. 8 in the brush driving step S110.

In the brush sensing step S120, it can be determined whether both of the two magnetic force sensing means positioned at the limiting points D of the reciprocating movement of the brush 430 sense the magnetic force generating means 435 or not, respectively.

If both of the two magnetic force sensing means 510*a* and 510*b* sense the magnetic force generating means 435 secured to the brush 430 respectively, the controller (not shown) determines that the filter assembly 4 is mounted to the duct, and an amount of the foreign matter stored in the case 410 is small, to start S211 the drying step.

However, in the control method described in this application, a step S121 for determining whether only one of the two magnetic force sensing means 510*a* and 510*b* senses the magnetic force generating means 435 or not can be progressed if both of the two magnetic force sensing means 510*a* and 510*b* cannot sense the magnetic force generating means 435.

A case when only one of the two magnetic force sensing means 510*a* and 510*b* senses the magnetic force generating means 435 implies that, though the filter assembly 4 is mounted to the duct, the amount of the foreign matter stored in the case is much, and a case when both of the two magnetic force sensing means 510*a* and 510*b* cannot sense the magnetic force generating means 435 implies a state that the filter assembly is not mounted to the duct, or the filter assembly is filled with the foreign matter, fully.

Therefore, if both of the two magnetic force sensing means 510*a* and 510*b* cannot sense the magnetic force generating means 435, in the control method of this application, a pre-drying notifying step S122, S123, and S124 for notifying the user of a state of the filter assembly 4 is progressed.

The pre-drying notifying step may have a filter alert notifying step S122 and a filter inspection requesting step S123 and S124.

The filter alert notifying step S122 is a step for requesting the user to remove the foreign matter stored in the filter assembly without stopping operation of the dryer if only one of the two magnetic force sensing means 510*a* and 510*b* senses the magnetic force generating means 435.

The filter inspection requesting step is a step for stopping S124 operation of the dryer after notifying S123 the user that it is a state the filter assembly 4 is not mounted to the duct, or the filter assembly 4 is filled with the foreign matter fully if both of the two magnetic force sensing means cannot sense the magnetic force generating means.

A case when only one of the two magnetic force sensing means 510*a* and 510*b* senses the magnetic force generating means 435 implies that the foreign matter is stored in the filter assembly 4 enough to interfere with the movement of the brush 430 even if the filter assembly 4 is not filled with the foreign matter fully.

Therefore, determining that the foreign matter stored in the filter assembly is close to be full, the controller requests S122 the user to remove the foreign matter from the filter assembly 4 with a display unit (Display a message) or a speaker (Issue an alarm) provided to the dryer, while the controller does not stop operation of the dryer. After the step of requesting S122 removal of the foreign matter stored in the case 410 of the filter assembly, the drying step S200 starts. The drying step S200 starts with making an air supply step S211 to progress after stopping S210 the operation of the brush 430. However, if the control method is configured such that the step of stopping S210 the operation of the brush 430 belongs to the mount sensing step S100, the drying step will start by making the air supply step S211 to progress.

If both of the two magnetic force sensing means cannot sense the magnetic force generating means 435 S123, the operation of the dryer can be stopped S124 for preventing a problem (Dropping of the drying efficiency and the dryer goes wrong) from taking place by making the drying step to progress in a state the filter assembly 4 is not provided, or the filter assembly is not ready to function, properly.

Upon finishing the mount sensing step S100, drying step S200 can be progressed for drying the drying objects by supplying air to the drum.

As described before, the drying step S200 may start by starting practicing of the air supply step S211 in which heated air or unheated air is supplied to the drum with the air supply unit.

If the heated air is supplied to the drum to dry the drying objects, though the air supply unit may be provided with a fan 11 and a heating means 9 provided to the duct, if the unheated air is supplied to dry the drying objects, the air supply unit may be provided with the fan 11.

In the drying step S200, a brush driving step S220 is progressed for repeating driving and stopping of the brush in predetermined periods during the air supply step S211 is in progress.

In the brush driving step S220, the brush 430 makes reciprocating movement (rotary reciprocation) on a filter cleaning region B of the filter portion 420 for transferring the foreign matter from the filter cleaning region to the lint compression region C.

That is, referring to FIG. 8, the brush driving step S220 is progressed by repeating operation of the brush 430 for a predetermined time period t1 and stopping the operation of the brush 430 for a predetermined time period t2. The brush driving step S220 is performed periodically until an air supply stopping step S250 which proceeds to a cooling step S260.

The air supply step S211 may be finished S250 if dryness of the drying object measured is higher than preset reference dryness, or a time period of air supply to the drum reaches to a preset reference time period.

Moreover, in the drying step S200, a step S230 for determining an amount of the foreign matter filtered at the filter portion 420 is progressed (An accumulated amount sensing step). The accumulated amount sensing step S230 may be progressed by sensing the magnetic force generating means 435 secured to the brush 430 with the magnetic force sensing means 510*a* and 510*b* provided to the limiting points D of the reciprocating movement of the brush 430, respectively.

Subsequently, since it can be implied that filter assembly 4 is not filled with the foreign matter fully if both of the two magnetic force sensing means 510*a* and 510*b* sense the magnetic force generating means in the accumulated amount sensing step S230, a step S240 for determining whether the air supply step is to be finished or not can be progressed.

As described before, whether the air supply step S211 is to be finished or not can be determined by whether dryness of the drying object is reached to the reference dryness or not, or whether a time period of air supply to the drum reaches to the preset reference time period or not.

If it is determined that the drying object is dried to a desired level in the step S240 for determining whether the air supply step is to be finished or not, though the cooling step S260 is progressed, if it is determined that the drying object is not dried to the desired level, the air supply step S211 and the brush driving step S220 can be repeated.

In the accumulated amount sensing step S230, if both of the two magnetic force sensing means did not sense the magnetic force generating means, the step S231 of whether only one of the two magnetic force sensing means 510*a* and 510*b* senses the magnetic force generating means 435 or not and an in-drying notifying step S232, S233, and S234 for notifying the user of a state of the filter assembly 4 can be progressed.

The in-drying notifying step may have a filter alert notifying step S232 and a filter inspection requesting step S233 and S234.

The filter alert notifying step S232 is a step for requesting the user to remove the foreign matter stored in the filter assembly without stopping operation of the dryer if only one of the two magnetic force sensing means 510*a* and 510*b* senses the magnetic force generating means 435.

Opposite to this, the filter inspection requesting step is a step for stopping S234 operation of the dryer after notifying S233 the user that it is a state the filter assembly 4 is filled with the foreign matter fully if both of the two magnetic force sensing means cannot sense the magnetic force generating means.

The case of only one of the two magnetic force sensing means 510*a* and 510*b* senses the magnetic force generating means 435 implies that the foreign matter is stored in the filter assembly 4 enough to interfere with movement of the brush 430 (Enough to cause an air flow rate drop) even though the filter assembly 4 is not filled with the foreign matter fully.

Therefore, the user may be requested S232 to remove the foreign matter from the filter assembly 4 through the display unit (Display a message) or the speaker (Issue an alarm) provided to the dryer.

A step S240 for determining whether the air supply step is to be finished or not succeeds the filter alert notifying step S232.

However, if the filter assembly 4 is filled with the foreign matter fully, the operation of the dryer can be stopped S234. This is for preventing a problem (Dropping of the drying efficiency and the dryer goes wrong) from taking place by making the drying step to progress in a state the filter assembly 4 is difficult to secure an adequate air flow rate.

In the control method described in this application, the cooling step S260 can be progressed if it is determined S240 that the drying object is dried to a desired level.

Since the heated air is supplied to the drying object in the air supply step S211, the drying object is in a state heated to a high temperature when the air supply step is finished S250. Therefore, if the user takes out the drying object from the drum right after finishing S250 of the air supply step, there is a danger of accident.

The cooling step S260 is provided for preventing the danger. The cooling step may be defined as a step for driving the fan 11 for a predetermined time period after stopping operation of the heating means 9 (Heater or the like). The cooling step S260 is finished as the operation of the fan 11 stops, which finishes the drying step S200.

After finishing the drying step S200, the final driving step (a filter cleaning step after drying) S300 can be progressed.

The final driving step S300 has an effect of eliminating necessity for a separate cleaning of the filter portion 420 when the dryer is used thereafter by inducing the user to clean the filter assembly depending on the amount of the foreign matter stored in the filter assembly before operation of the dryer is finished.

The final driving step S300 includes a brush final driving step S310 for operating the brush driving unit, such as the brush driving motor (not shown), for a predetermined time period, and a step S320 for determining the amount of the foreign matter stored in the filter assembly with the final driving step.

In this case, even if it may be preferable that the brush final driving step S310 starts after finishing the cooling step S260, if the brush final driving step S310 starts while the cooling step S260 is in progress, the progress has an effect of reducing an operation time period of the dryer.

In the brush final driving step S310, the brush driving unit (not shown) is controlled to make the brush 430 to reciprocate the filter cleaning region B of the filter portion 420 for a predetermined time period. Therefore, as shown in FIG. 8, in the brush final driving step S310, the brush 430 reciprocates the filter cleaning region B for a preset time period t3 before operation of the dryer stops.

With this, the foreign matter can be removed from the filter portion 420 before operation of the dryer stops.

In the meantime, the step S320 for determining the amount of the foreign matter stored in the filter assembly can progress as the lead switches 510*a* and 510*b* sense the positions of the magnetic force generating means 435 while the brush final driving step S310 is in progress, respectively.

That is, the step S320 for determining the amount of the foreign matter stored in the filter assembly progresses by determining whether both of the two magnetic force sensing means 510*a* and 510*b* positioned at the limiting points D of the reciprocating movement of the brush 430 sense the magnetic force generating means 435 or not.

If both of the two magnetic force sensing means 510*a* and 510*b* sense the magnetic force generating means 435 secured to the brush 430, it can be determined that the amount of the foreign matter stored in the case 410 of the filter assembly is small to stop the operation of the dryer without any notifying step.

However, even if any one of the two magnetic force sensing means 510*a* and 510*b* cannot sense the magnetic force generating means 435, operation of the dryer can be finished after making a final notifying step S321 to progress, in which user's inspection of the filter assembly is requested with the display unit or the speaker.

Figure 9:
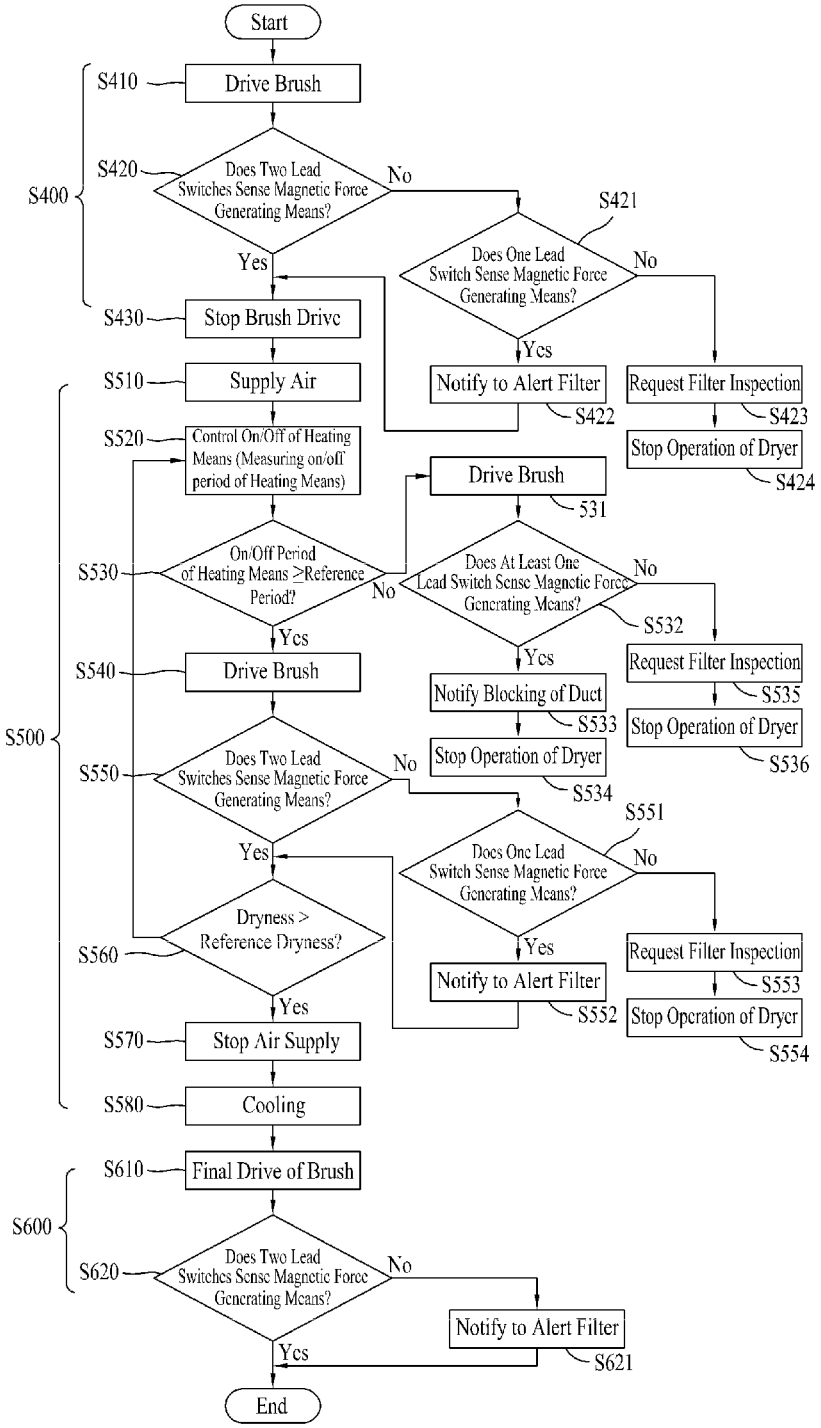
FIGS. 9 and 10 illustrate flow charts showing the steps of methods for controlling a dryer for auto-cleaning of a filter portion in accordance with another implementation, respectively.
Figure 10:
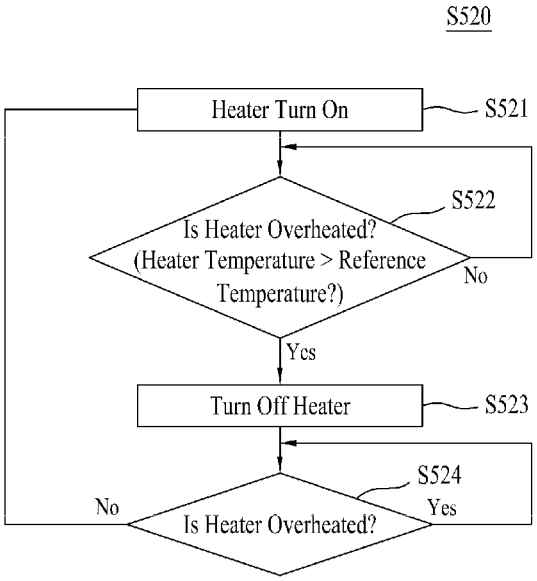

FIGS. 9 and 10 illustrate a method for controlling a dryer in accordance with another implementation, characterized in that not only blocking of the filter assembly, but also blocking of the duct, can be determined.

Alike the control method illustrated in FIG. 7, the control method of the implementation also includes a mount sensing step S400, a drying step S500, and a final driving step S600. Since the mount sensing step S400, and the final driving step S600 of the implementation are the same with the mount sensing step S100, and the final driving step S300 in the implementation described with reference to FIG. 7 respectively, the implementation will be described focused on the drying step S500.

The drying step S500 of the implementation starts with making an air supplying step S510 to progress.

If the heated air is supplied to the drum to dry the drying object, the air supply step S510 is progressed by heating means 9 and a fan 11 provided to a duct.

While the air supply step S510 is in progress, an operation period of the heating means 9 is measured S520 in the implementation.

If power supplied to the heating means 9 is measured with bimetal, the measurement S520 of the operation period of the heating means may be progressed by measuring a time period required from nth time supply of the power to the heating means to (n+1)th time supply of the power to the heating means with the controller (not shown), or by measuring a time period required for re-supply of the power after the power supply to the heating means is cut off.

In the meantime, the measurement S520 of the operation period of the heating means may be progressed by a method shown in FIG. 10.

The implementation is characterized in that the controller (not shown) compares a temperature of the heating means 9 with a reference temperature, determines whether the heating means is overheated or not, and measures the operation period of the heating means while supplying or cutting off the power supply to the heating means 9 depending on whether the heating means is overheated or not.

That is, after supplying S521 the power to the heating means 9, if it is determined that the heating means is overheated, the controller cuts off S523 the power supply to the heating means, and, if the controller determines that the overheating is resolved S524 after the power supply to the heating means 9 is cut off, the controller re-supplies S521 the power to the heating means 9.

In this case, the step S520 for measuring the operation period of the heating means 9 may be progressed by measuring a time period required for resupplying S521 the power to the heating means after the controller cuts off the power S523, or by measuring a time period required from an nth time power supply S521 to the heating means to (n+1)th time power supply S521 to the heating means.

Additionally, once the operation period of the heating means is measured, as shown in FIG. 9, the operation period measured thus can be compared to a preset reference period S530.

If the operation period measured thus is shorter than the preset reference period S530, a blocking sorting step S531, S532, S533, and S534 can be progressed, for determining whether the filter portion 420 is blocked by the foreign matter or the duct is blocked by the foreign matter.

The blocking sorting step includes a step S531 for driving the brush 430 for a predetermined time period by controlling a brush driving unit (not shown), and a step S532 for determining whether at least one of the two magnetic force sensing means 510*a* and 510*b* positioned at limiting points D of reciprocating movement of the brush senses the magnetic force generating means 435 or not during the brush 430 is driven.

If at least one of the two magnetic force sensing means senses a position of the magnetic force generating means 435, a duct inspection requesting step can be progressed for notifying S523 the user of blocking of the duct with a display unit or a speaker and stopping the operation S534 of the dryer.

However, if both of the two magnetic force sensing means cannot sense the magnetic force generating means, a filter inspection requesting step can be progressed for notifying S535 the user that the filter assembly 4 is filled with the foreign matter fully (notifying that the filer portion is blocked with the foreign matter) with the display unit or the speaker and stopping the operation S536 of the dryer.

In a case of the dryer, in order to prevent a problem from causing by overheating the heating means 9, the controller (not shown) stops operation of the heating means to make a temperature of the heating means to be below the reference temperature if the temperature of the heating means is higher than the reference temperature.

If the filter assembly 4 has a large amount of the foreign matter therein or the filter portion 420 is blocked with the foreign matter, an air flow rate being discharged from the drum can become lower.

If the air flow rate being discharged from the drum becomes lower, since the heating means 9 is overheated easily, the operation period of the heating means 9 tends to become shorter.

Therefore, if the operation period of the heating means 9 and the amount of the foreign matter stored in the filter assembly are measured, it can be determined that whether the duct is blocked by the foreign matter or the filter portion is blocked by the foreign matter.

That is, the filter assembly 4 is not filled with the foreign matter fully even if the operation period of the heating means 9 is shorter than the reference period, it may be determined that the duct is blocked. It is highly possible that the easy overheating of the heating means 9 even if the filter portion is not blocked is caused by blocking of the duct.

If the operation period of the heating means 9 is shorter than the reference period and the filter assembly 4 is filled with the foreign matter fully, it is highly possible that the reason of the shorter operation period of the heating means 9 is caused by the blocking of the filter portion 420.

The blocking sorting step S531, S532, S533, S534, and S535 described before is utilization of such characteristics of the dryer.

If the operation period of the heating means 9 measured thus is longer than the reference period, a brush driving step S540 can be progressed for making the brush 430 to reciprocate (Rotary reciprocation) the filter cleaning region B of the filter portion 420 to transfer the foreign matter to the lint compression region C. The brush driving step S540 is performed periodically until an air supply step S570 which proceeds to a cooling step S580.

Moreover, the drying step S500 of the implementation progresses a step S550 (An accumulated amount sensing step) for determining an amount of the foreign matter filtered by the filter portion 420. The accumulated amount sensing step may be progressed as the magnetic force sensing means 510*a* and 510*b* respectively provided to the limiting points D (A rotary reciprocating range of the brush) of the reciprocating movement of the brush 430 sense the magnetic force generating means 435 secured to the brush 430.

If both of the two magnetic force sensing means sense the magnetic force generating means, implying that the filter assembly 4 is not filled with the foreign matter fully, a step S560 for determining whether the air supply step is to be finished or not can be progressed.

Whether the air supply step S560 is to be finished or not can be determined by whether dryness of the drying object reaches to reference dryness or whether a time period in which the air is supplied to the drum reaches to a reference time period or not.

If it is determined that the dryness of the drying object reaches to a desired level in the step S560 for determining finish of the air supply step, though the cooling step S580 is progressed after finishing S570 the air supply step, if it is determined that the dryness of the drying object does not reach to the desired level, in the control method of the present invention, the steps described before can be repeated.

If both of the two magnetic force sensing means cannot sense the magnetic force generating means in the accumulated amount sensing step S550, a step S551 for determining whether only one of the magnetic force sensing means 510*a* and 510*b* senses the magnetic force generating means 435 or not and an in-drying notifying step S552, S553, and S554 for notifying the user of a state of the filter assembly 4 can be progressed.

The in-drying notifying step may have a filter alert notifying step S552 and a filter inspection requesting step S553 and S554.

The filter alert notifying step S552 is a step for requesting the user to remove the foreign matter stored in the filter assembly without stopping operation of the dryer if only one of the two magnetic force sensing means 510*a* and 510*b* senses the magnetic force generating means 435.

Opposite to this, the filter inspection requesting step is a step for stopping S554 operation of the dryer after notifying S553 the user that it is a state the filter assembly 4 is filled with the foreign matter fully if both of the two magnetic force sensing means cannot sense the magnetic force generating means.

A step S560 for determining whether the air supply step is to be finished or not succeeds the filter alert notifying step S552.

In the control method described in this application, the cooling step S580 can be progressed if it is determined S560 that the drying object is dried to a desired level. The cooling step S580 is finished as operation of the fan 11 stops, and by this, the drying step S500 of the implementation is finished.

After finishing the drying step S500, the final driving step (a filter cleaning step after drying) S600 can be progressed, which is the same with the implementation described with reference to FIG. 7, and detailed description of which will be omitted.

It will be apparent that modifications and variations can be made from the disclosed examples while remaining true to the implementations described. Thus, it is intended that the described implementations include modifications and variations of the disclosed examples.

What is claimed is:

1. A method for controlling a dryer, the method comprising:

attempting to determine a position of a brush that separates foreign matter from a filter portion of a filter assembly positioned to contact air that has exited from a drum of the dryer; and operating the dryer based on the attempt to determine the position of the brush, wherein attempting to determine a position of the brush comprises:

detecting whether a first sensor detects an end of the brush at a first end point of rotational movement of the brush;

detecting whether a second sensor detects the end of the brush at a second end point of the rotational movement of the brush, the second sensor being different from the first sensor and the second end point of the rotational movement of the brush being spaced apart from the first end point; and determining whether the end of the brush is sensed by neither the first sensor nor the second sensor, one of the first sensor and the second sensor, or both of the first sensor and the second sensor, wherein operating the dryer based on the attempt to determine the position of the brush comprises:

stopping operation of the dryer based on a determination that the end of the brush is sensed by neither the first sensor nor the second sensor;

enabling operation of the dryer and providing an alert to clean the filter assembly based on a determination that the end of the brush is sensed by one of the first sensor and the second sensor; and enabling operation of the dryer without providing an alert based on a determination that the end of the brush is sensed by both of the first sensor and the second sensor.

2. A method for controlling a dryer, the method comprising:

putting a brush driving unit into operation, the brush driving unit being configured to drive a brush that separates foreign matter from a filter portion of a filter assembly positioned to contact air that has exited from a drum of the dryer;

after putting the brush driving unit into operation, gathering information related to the operation of the brush driving unit;

controlling operation of the dryer based on the gathered information related to the operation of the brush driving unit, wherein gathering information related to the operation of the brush driving unit comprises determining a position of the brush during the operation of the brush driving unit, wherein determining the position of the brush during the operation of the brush driving unit comprises:

detecting whether a first sensor detects an end of the brush at a first end point of rotational movement of the brush;

detecting whether a second sensor detects the end of the brush at a second end point of the rotational movement of the brush, the second sensor being different from the first sensor and the second end point of the rotational movement of the brush being spaced apart from the first end point; and determining whether the end of the brush is sensed by neither the first sensor nor the second sensor, one of the first sensor and the second sensor, or both of the first sensor and the second sensor, and wherein controlling operation of the dryer based on the gathered information related to the operation of the brush driving unit comprises controlling operation of the dryer based on the position of the brush during the operation of the brush driving unit, wherein controlling operation of the dryer based on the position of the brush during the operation of the brush driving unit comprises controlling the operation of the dryer to stop based on a determination that the end of the brush is sensed by neither the first sensor nor the second sensor.

3. The method according to claim 2, wherein putting the brush driving unit into operation and gathering information related to the operation of the brush driving unit take place before starting a drying cycle.

4. The method according to claim 3, further comprising receiving a user input command to start the drying cycle, wherein putting the brush driving unit into operation comprises putting the brush driving unit into operation in response to the user input command to start the drying cycle;

wherein gathering information related to the operation of the brush driving unit comprises gathering information that indicates whether or not the operation of the brush driving unit was successful; and wherein controlling operation of the dryer based on the gathered information related to the operation of the brush driving unit comprises controlling the dryer to start the drying cycle based on the gathered information indicating that the operation of the brush driving unit was successful.

5. The method according to claim 2, wherein putting the brush driving unit into operation and gathering information related to the operation of the brush driving unit take place before heated air is supplied to the drum.

6. The method according to claim 2, wherein controlling operation of the dryer based on the position of the brush during the operation of the brush driving unit comprises controlling the operation of the dryer to progress based on a determination that the end of the brush is sensed by one of the first sensor and the second sensor or both of the first sensor and the second sensor.

7. The method according to claim 6, further comprising alerting a user of foreign matter in the filter assembly based on a determination that the end of the brush is sensed by one of the first sensor and the second sensor.

8. The method according to claim 2, further comprising alerting a user that either foreign matter needs to be removed from the filter assembly or that the filter assembly has not been properly inserted based on the determination that the end of the brush is sensed by neither the first sensor nor the second sensor.

9. The method according to claim 2, wherein putting the brush driving unit into operation comprises operating the brush driving unit at predetermined periods during the operation of the dryer.

10. The method according to claim 2, further comprising supplying heated air to the drum and discharging the heated air from the drum through a duct, wherein the heated air is supplied by a heater that operates at a temperature below a preset temperature, the heater being configured to stop operation based on the temperature exceeding the preset temperature.

11. The method according to claim 2, further comprising:

detecting that an operation period of the heater is longer than a reference period; and based on detection that the operation period of the heater is longer than the reference period, determining whether the filter portion is blocked by foreign matter or the duct is blocked by foreign matter.

12. The method according to claim 11, wherein determining whether the filter portion is blocked by foreign matter or the duct is blocked by foreign matter comprises putting the brush driving unit into operation and gathering information related to the operation of the brush driving unit, wherein gathering information related to the operation of the brush driving unit comprises determining a position of the brush during the operation of the brush driving unit, and wherein determining the position of the brush during the operation of the brush driving unit comprises:

detecting whether a first sensor detects an end of the brush at a first end point of rotational movement of the brush;

detecting whether a second sensor detects the end of the brush at a second end point of the rotational movement of the brush, the second sensor being different from the first sensor and the second end point of the rotational movement of the brush being spaced apart from the first end point; and determining whether the end of the brush is sensed by neither the first sensor nor the second sensor, one of the first sensor and the second sensor, or both of the first sensor and the second sensor.

13. The method according to claim 12, wherein determining whether the filter portion is blocked by foreign matter or the duct is blocked by foreign matter comprises determining that the duct is blocked by foreign matter based on a determination that the end of the brush is sensed by one of the first sensor and the second sensor or both of the first sensor and the second sensor; further comprising:

alerting a user of foreign matter in the duct based on the determination that the duct is blocked by foreign matter.

14. The method according to claim 12, wherein determining whether the filter portion is blocked by foreign matter or the duct is blocked by foreign matter comprises determining that the filter portion is blocked by foreign matter based on a determination that the end of the brush is sensed by neither the first sensor nor the second sensor; further comprising:

alerting a user of foreign matter in the filter portion based on the determination that the filter portion is blocked by foreign matter.

15. A method for determining a source of clogging in a dryer, the method comprising:

supplying heated air to a drum and discharging the heated air from the drum through a duct, wherein the heated air is supplied by a heater that operates at a temperature below a preset temperature, the heater being configured to stop operation based on the temperature exceeding the preset temperature;

detecting that an operation period of the heater is longer than a reference period; and based on detection that the operation period of the heater is longer than the reference period, determining whether a filter portion of a filter assembly is blocked by foreign matter or the duct is blocked by foreign matter, the filter portion being positioned to contact air that has exited from a drum of the dryer, wherein determining whether the filter portion is blocked by foreign matter or the duct is blocked by foreign matter comprises determining a position of a brush during operation of a brush driving unit, the brush separating foreign matter from the filter portion of the filter assembly based on operation of the brush driving unit, wherein determining the position of the brush during the operation of the brush driving unit comprises:

detecting whether a first sensor detects an end of the brush at a first end point of rotational movement of the brush;

detecting whether a second sensor detects the end of the brush at a second end point of the rotational movement of the brush, the second sensor being different from the first sensor and the second end point of the rotational movement of the brush being spaced apart from the first end point; and determining whether the end of the brush is sensed by neither the first sensor nor the second sensor, one of the first sensor and the second sensor, or both of the first sensor and the second sensor, and wherein determining whether the filter portion is blocked by foreign matter or the duct is blocked by foreign matter comprises:

determining that the duct is blocked by foreign matter based on a determination that the end of the brush is sensed by one of the first sensor and the second sensor or both of the first sensor and the second sensor; and determining that the filter portion is blocked by foreign matter based on a determination that the end of the brush is sensed by neither the first sensor nor the second sensor.

* * * * *